United States Patent [19]

Marsocci et al.

[11] Patent Number: 4,517,555

[45] Date of Patent: May 14, 1985

[54] SMOKE DETECTOR WITH REMOTE ALARM INDICATION

[75] Inventors: Angelo A. Marsocci, Duxbury; Walter F. Schuchard, Hingham, both of Mass.

[73] Assignee: American District Telegraph Co., Jersey City, N.J.

[21] Appl. No.: 601,256

[22] Filed: Apr. 17, 1984

[51] Int. Cl.[3] ..... G08B 19/00; G08B 17/10

[52] U.S. Cl. ..... 340/522; 307/116; 324/133; 340/627; 340/628; 340/630; 340/657; 340/660; 340/664

[58] Field of Search ..... 340/627, 628, 629, 630, 340/632, 633, 634, 657, 660, 664; 324/133; 328/118; 307/116, 127, 138, 236

[56] References Cited

U.S. PATENT DOCUMENTS

| | | | |
|---|---|---|---|
| 2,250,214 | 7/1941 | Ashworth | 340/664 X |
| 2,964,682 | 12/1960 | Jansen | 340/657 X |
| 4,149,162 | 4/1979 | Enemark et al. | 340/630 X |

*Primary Examiner*—James L. Rowland
*Assistant Examiner*—Daniel Myer
*Attorney, Agent, or Firm*—James H. Grover

[57] ABSTRACT

A smoke detector receiving at two input terminals DC power from a remote source not only gives an alarm indication in response to a significant density of smoke, but senses the polarity of DC power at the terminals and generates a secondary signal, distinguishable from the alarm signal, when the polarity of power source is reversed.

9 Claims, 1 Drawing Figure

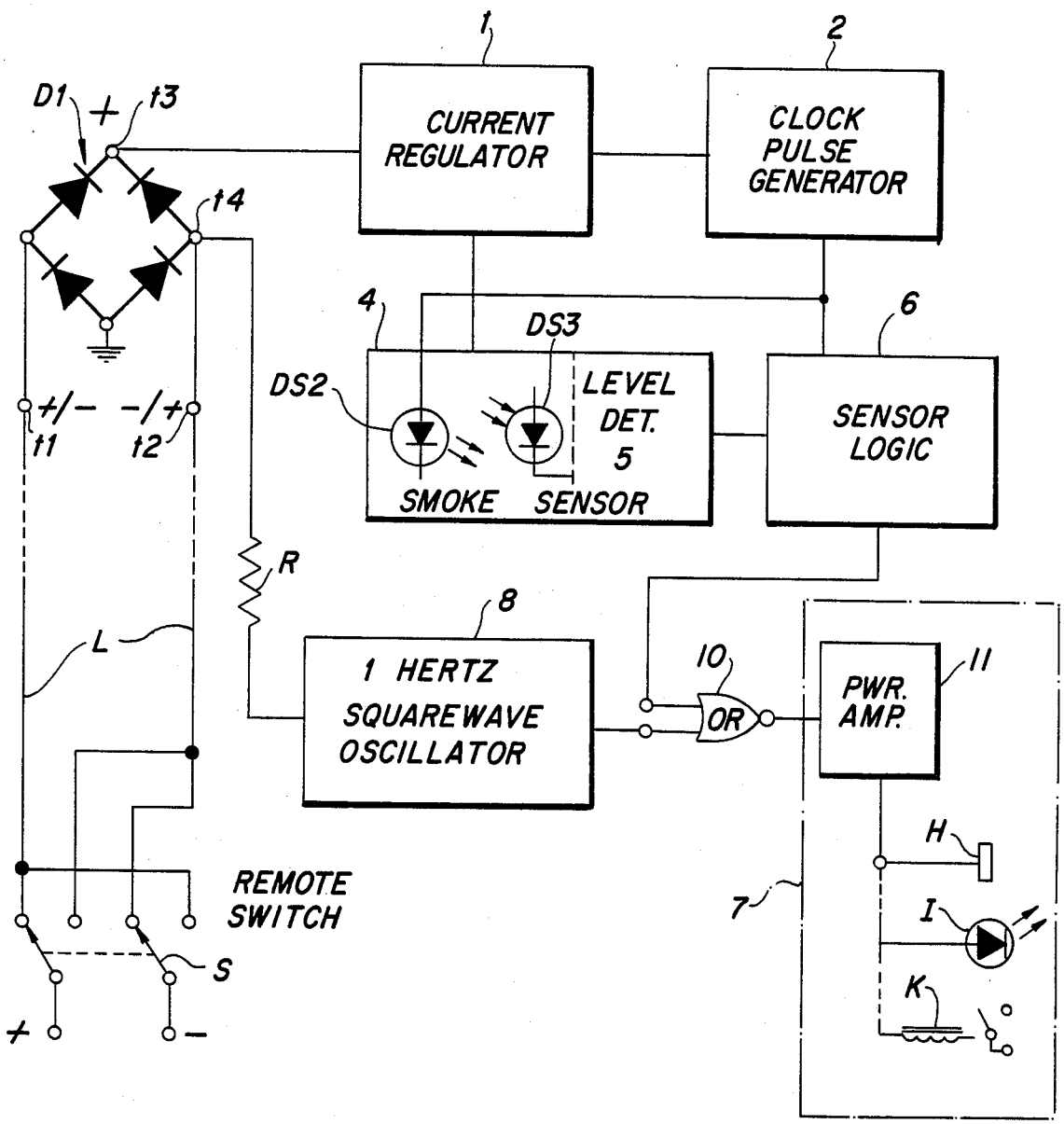
1
2
CURRENT REGULATOR
CLOCK PULSE GENERATOR
D1
+
t3
t4
4
DS3
6
DS2
LEVEL DET. 5
SENSOR LOGIC
+/−
−/+
t1
t2
SMOKE SENSOR
R
8
L
1 HERTZ SQUAREWAVE OSCILLATOR
10
OR
PWR. AMP.
11
H
REMOTE SWITCH
7
I
S
K
+
−

SMOKE DETECTOR WITH REMOTE ALARM INDICATION

BACKGROUND OF THE INVENTION

Smoke detectors, gas detectors and like apparatus for signalling an environmental alarm condition are commonly connected to a remote central power supply, usually a low voltage direct current source. Only a two-wire line is needed to supply the DC power to a detector unit for detection although additional wires may be used for other purposes. It is possible not only to transmit power through the two-wire line but also to transmit signals from the remote power source to one or more detector units by reversing the polarity on the two power supply wires. It is one object of the present invention to provide apparatus which utilizes polarity reversal in two-wire supply lines and a single alarm indicator.

SUMMARY OF THE INVENTION

According to the invention apparatus for signalling an environmental alarm condition comprises two input terminals receiving direct current electrical power from a remote source supplying current in a normal and an alternative polarity, an environmental sensor producing an alarm signal in response to an alarm condition; and an alarm responsive to the alarm signal to indicate the alarm condition in a first mode of indication; characterized by means for sensing the polarity of current at the power input terminals including a generator of a secondary signal distinguished from the alarm signal when current at the input terminals is in the alternative polarity; and means coupling the sensing means and secondary signal to the alarm to cause the alarm to operate in a second mode of indication.

DRAWING

The single FIGURE is a schematic diagram of an electronic circuit for a smoke detector according to the invention.

DESCRIPTION

The illustrated smoke detector circuit is supplied low voltage DC power from a remote alarm ganged switch S along a two-wire line L to two input terminals t1 and t2 which normally are polarized with t1 positive and t2 negative with the switch S in the position shown. Across the power input terminals t1, t2 is a conventional diode bridge D1 which has no rectifying function but holds the polarity position at the plus (+) terminal t3 of the bridge irrespective of the position of the remote switch S and the consequent polarity of the two-wire line L. Across the bridge are two arms between the polarized plus terminal (+) and ground, each arm having two diodes with an intermediate terminal.

Current from the (+) terminal t3 is supplied through a conventional current regulator to a clock pulse generator 2 and a smoke sensor 4 and associated logic 6 such as are shown in U.S. Pat. No. 4,149,162, issued Apr. 10, 1979 to Robert B. Enemark et al for Battery Discriminator Circuit for Smoke Detectors, which is incorporated herein by reference. The smoke sensor includes a light emitting diode DS2 which emits light pulses at the clock pulse generator rate. A photoresponsive diode DS3 senses light from the photodiode indirectly by scattering from smoke particles. When a significant density of smoke is present the output voltage of the photodiode DS3 rises above the threshold of a level detector 5 which produces a pulsed alarm signal. If the alarm signal persists for three consecutive pulses, for example, existence of a true alarm condition is verified by the logic position 6 of the sensor and a steady alarm signal is relayed by the logic through an OR gate 10 such as Motorola Co. type 14071 to the power amplifier 11 of an alarm 7. The amplifier then operates in an alarm mode by applying a continuous driving current to an alarm indicator such as a horn H, a light I or a relay K.

With the remote switch S in the position shown and the left power input terminal t1 positive, current will flow only in the left arm of the bridge connected to the normally positive terminal t1, while the opposite arm of the bridge through terminal t4 will be substantially at ground potential. However, when the remote switch S is transferred from the position shown and reverses the power input terminals to the alternative polarity with t1 negative and t2 positive, current will flow through the bridge arm including the terminal t4 and a positive voltage will appear at the terminal t4, the bridge and terminal thus acting as polarity sensing means.

The positive voltage sensed by terminal t4 is coupled by a 15 kilohm resistor R to a 1 Hertz square wave oscillator 8 which applies a secondary signal of pulses at a 1 Hertz repetition rate to the alternate input of the OR gate 10. If the smoke sensor 4, 6 is not in alarm state the power amplitier 11 of the alarm 7 and the indicators H, I or K will operate in a second, interrupted mode easily distinguished from the continuous, alarm mode.

But, if the smoke sensor 4, 6 is in alarm state applying a continuous alarm mode signal to the OR gate, the alarm signal will override the secondary signal input to the OR gate and the OR gate will respond only to the alarm signal and transmit only a continuous alarm mode of signal to the aarm.

It should be understood that the present disclosure is for the purpose of illustration only and that this invention includes all modifications and equivalents which fall within the scope of the appended claims.

We claim:

1. Apparatus for indicating an environmental alarm condition comprising:

two input terminals receiving direct current electrical power from a remote source supplying current in a normal and an alternative polarity, an environmental sensor producing an alarm signal in response to an alarm condition, and an alarm responsive to the alarm signal to indicate the alarm condition in a first mode of indication;

characterized by means for sensing the polarity of current at the power input terminals including a generator of a secondary signal distinguished from the alarm signal when current at the input terminals is in the alternative polarity; and means coupling the sensing means and secondary slgnal to the alarm to cause the alarm to operate in a second mode of indication.

2. Apparatus according to claim 1 wherein the polarity sensing means comprises a diode bridge across the power input terminals.

3. Apparatus according to claim 1 including a resistive connection between the polarity sensing means and the secondary signal generator.

4. Apparatus according to claim 1 wherein the polarity sensing means includes a diode bridge across the power input terminals and a resistive connection between the bridge and the secondary signal generator.

5. Apparatus according to claim 1 wherein the secondary signal generator includes an oscillator.

6. Apparatus according to claim 5 including a dividing circuit between the second signal generator and alarm.

7. Apparatus according to claim 1 wherein the coupling means comprises an OR gate connected to the alarm, the gate having inputs respectively connected to the environmental sensor and polarity sensing means for alternative coupling of the alarm signal and secondary signal to the alarm.

8. Apparatus according to claim 7 wherein the gate is effectively responsive only to the alarm signal of the sensor when both the alarm and secondary signals are applied to the gate so as to cause the alarm to operate only in the first mode.

9. Apparatus according to claim 1 wherein the polarity sensing means comprises a bridge with two arms each having two diodes connected across the bridge through intermediate power input terminals to a polarized terminal connected to the environmental sensor, the coupling means being connected to one of the intermediate terminals.

* * * * *